United States Patent [19]

Collet

[11] Patent Number: 4,562,888

[45] Date of Patent: Jan. 7, 1986

[54] TUBING HEAD ADAPTER AND VALVE

[76] Inventor: James R. Collet, 120 Exploration Rd., Broussard, La. 70518

[21] Appl. No.: 570,183

[22] Filed: Jan. 12, 1984

[51] Int. Cl.[4] ..... E21B 34/02

[52] U.S. Cl. ..... 166/97; 166/330; 251/315; 251/148

[58] Field of Search ..... 166/75 A, 75 R, 91, 166/95, 97, 330, 368; 251/148, 309, 315

[56] References Cited

U.S. PATENT DOCUMENTS 4,465,092 8/1984 Vitale ..... 251/148

OTHER PUBLICATIONS

"Composite Catalog of Oil Field Equipment and Services", World Oil, vol. 5, 35th revision, 1982–1983.

*Primary Examiner*—Stephen J. Novosad

*Assistant Examiner*—William P. Neuder

*Attorney, Agent, or Firm*—Keaty & Keaty

[57] ABSTRACT

An improved tubing head adapter contains a ball valve with special actuation provisions. The tubing head adapter is placed immediately atop a tubing spool in a standard oilwell makeup. The ball valve within the tubing head adapter provides a full positive closure of the pressure opening and yet on a full open position, allows complete workthrough of the tubing. Standard back pressure valves may be installed in a hanger nipple, housed within the tubing head adapter; the christmas tree is installed above adapter. An optional stem lock or similar theft resistant, actuation resistant locking means on the ball valve stem permits the ball valve to be secured open to the full open position on a production christmas tree. This reduces the chances of theft of the christmas tree by preventing pressure shutoff, which is necessary before any components can be removed.

3 Claims, 1 Drawing Figure

TUBING HEAD ADAPTER AND VALVE

BACKGROUND OF THE INVENTION

It is customary in the oilfield industry to make up the above ground portion of an oilwell casing by attaching a tubing head adapter directly or via a tubing spool to the casing head. The tubing head adapter serves two purposes. First, it is threaded internally to accept tubing hangers and an optional back pressure control valve; it serves thereby to terminate the upper end of the production tubing, the innermost tubing within a producing oilwell. Secondly, it provides the initial flow control connections to the valves and plumbing which collectively make up the unit known as a christmas tree.

Above the tubing head adapter are found at least two major control master valves, usually called the bottom and top master valves. The purpose of the bottom master valve is to provide a backup shutoff mechanism in the event of a failure within the top master valve and a subsequent failure within the christmas tree structure. The bottom master valve is normally left in the open position. The top master valve is the main shutoff valve for the production oilwell and provides normally unrestricted flow to the christmas tree, being shut only when it is necessary to break open the christmas tree for some purpose.

Above the top master valve is found the christmas tree. This is a collection of chokes and valves necessary for metering and monitoring pressures, reducing pressures, diverting flows, and otherwise connecting a particular producing well to an overall network for distributing well product in a production operation.

A back pressure valve, inserted wtihin the tubing head, is used to prevent overflow in the event of removal or massive failure of the christmas tree, such as if the master valves are accidently knocked off. Its use creates significant problems, in that it is both difficult and time consuming to restore the flow of the producing well once the christmas tree has been repaired. A back pressure valve is an emergency, shut only device requiring skilled crews and special techniques for reopening it against significant and dangerous uphole flow pressures.

SUMMARY OF THE INVENTION

It is the essence of this invention to combine the back pressure valve, bottom master valve and tubing head functions into a single piece of equipment of sufficient strength and reliability that it can safely replace both the back pressure valve and the bottom master valve.

In essence, the instant invention comprises a tubing head adapter which has been modified so as to include an integral ball valve. The design of the ball valve is such that in the open position it presents an unobstructed full diameter throatway for downhole production working, including, if necessary, pulling either production or completion tubing, as well as any wire line operations that may be necessary.

The construction of the ball valve is further such that in the closed position it provides a massive, non-deformable, non-jammable positive shutoff under all conditions short of total failure of the casing.

The ball itself is packed into the tubing head adapter of the current invention by an upper seat, clamped and sealed by a threaded connection. A staggered series of pressure rings seal the ball stem against leaking in the event of seal or seal failure. The ball is a floating ball for maximum seating effectiveness.

The overall structure is extremely reliable, substantially stronger than alternative valves and provides a simplified, safer solution to the problem of the bottom valving and connection to a christmas tree.

It is an object of this invention to provide a modified tubing head adapter which can eliminate the need for setting a back pressure valve in an oilwell christmas tree.

It is a further object of this invention to provide an improved tubing head adapter which permits the elimination of the bottom master valve within a christmas tree.

It is a further object of this invention to provide a tubing head adapter which provides a means of positive shutoff of flow from a well while still permitting all work through on the well.

It is an object of this invention to provide an improved tubing head adapter having all of the advantages set forth above or in the detailed description of the preferred embodiment below.

DETAILED DESCRIPTION OF THE PREFERRED EMBODIMENT

Figure 1:
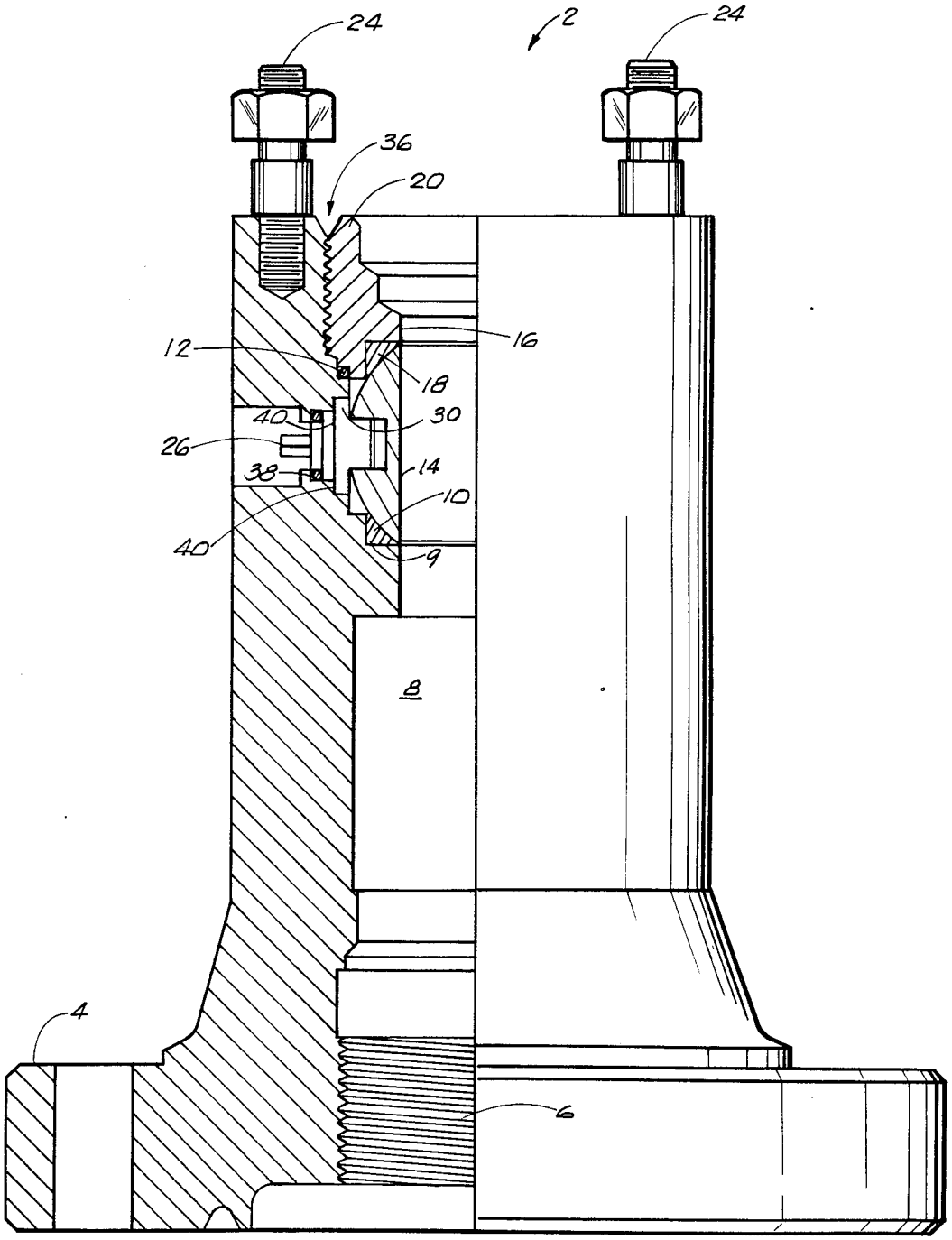
FIG. 1 is a cutaway view of the improved tubing head adapter showing the ball valve as installed.

Referring to FIG. 1, a tubing head adapter 2 is shown to be constructed of an essentially vertically oriented cylindrical component having a base flange 4 adapted for mating to a standard casing head in an oilwell. The body of the tubing head adapter 2 is constructed of an essentially monolithic steel construction as is well known in the art for oilfield plumbing as it is required to resist substantially all of the pressure of the production flow within the oilwell. Within the tubing head adapter 2 is found a vertical fluid flow chamber 8 which is an essentially cylindrical passage arising through the tubing head adapter 2 providing for the unrestricted flow of fluid from within the oilwell to a point above the tubing head adapter.

The bottom portion of the fluid flow chamber is seen to be tapped for the tubing hanger nipple threads 6 which may be any of a number of well understood thread adaptations permitting the installation of a tubing hanger nipple, in turn including internal provisions for one of a number of back pressure valves, flow restrictors or the like.

Extending circumferentially around the interior of the fluid flow chamber 8 at a point within the tubing head adapter 2 is found an annular ring protrusion comprising a lower ball seat 9. Upon the lower ball seat 9 is found a lower ball seat ring 10. Seat 9 has an opening for the passage of fluid through the fluid flow chamber 8; in combination with ring 10, it supports, adapted for free rotation, floating ball valve ball 14.

The ball valve ball 14 is an essentially cylindrical or spherical ball having a passageway cut diametrically through it in one direction for permitting the flow of a fluid, but being otherwise a solid ball.

Ball 14 is clamped floatingly within a valve chamber formed cooperatively by lower ball seat 9 and an upper ball seat 16. Upper ball seat 16 is sealed against leaks by an upper seat ring 18. Lower ball seat 9 is sealed against leaks by means of an interposed lower ball seat ring 10. Both seat rings 10 and 18 are adaptingly tapered so as to sealingly support ball in a centered position within seats 9 and 16.

Upper ball seat 16 is clamped cooperatively against ball 14 by the tubing head adapter head clamp or upper screwed gland 20, which is an essentially annular ring of steel threadingly engaged within the body of adapter 2. An O-ring 12 is clampingly interposed at the base of gland 20 against an O-ring seat 30. A ring groove 36 at the upper juncture of gland 20 and adapter body 2 provides a recess for the required seal (not shown) between the adapter 2 and a master valve, usually installed immediately above adapter 2.

In addition, in this embodiment, an array of studs 24 are tapped or driven into the top of adapter 2, providing hereby, with ring groove 36, provisions for flange connection of the christmas tree to the adapter 2.

An alternative embodiment provides a necked down, threaded connection at the upper end of adapter 2, so as to permit its use as a screw tubing head adapter.

Cooperatively, the lower ball seat 9 and the upper ball seat 16 form a sealed valve chamber in which is floated valve ball 14. Valve ball 14 is actuated rotationally from an open to a closed position reciprocally by means of a rotating stem 26 extending through a wall of the tubing head adapter 2. Stem 26 is sealed against leaks by means of a stem packing plate 30. Stem packing plate 30 cooperatively is locked by stem thrust bearing and seal 38, against stem retention shoulder 40.

In operation, the tubing head adapter 2 is installed upon a tubing spool as is well understood in the art. The stem 26 is rotated so as to position the ball 14 into the substantially open position permitting working through the ball opening and through the fluid flow chamber 8.

The appropriate tubing hanger nipples are set from the tubing hanger nipple thread 6 and then in turn the appropriate valves, chokes and other paraphernalia comprising the christmas tree are assembled and clamped to the head of the tubing head adapter tube by means of the studs 24, for a flanged makeup or by a threaded adapter (not shown).

If it is necessary for any reason to positively cease flow from the well rotation of the stem 26 will rotate the ball 14 from the open to a substantially closed position. Cooperatingly the lower ball seat 9 and the upper ball seat 16, being positively clamped by the threaded insertion of gland 20 within adapter 2, provide a positive seal. The ball 14 floats within tapered seal rings 10 and 18; this floating assures a positive leak seal. The only other point at which there may be any leaks are through the opening provided for the control stem 26. Any leaks of this nature are sealed by thrust bearing and seal 38; any failure results in direct pressure contact of stem plate 30 against shoulder 40, cutting off leakage flow.

Stem 26 is seen to be recessed within the body of adapter 2. Any of a number of standard, well understood locking means may be used to secure stem 26 against actuation once tubing head adaptor 2 has been installed in ball 14 rotated to the open position for production. This provision prevents inadvertent or unauthorized closure of ball 14 and serves thereby as an additional deterrent to theft of the christmas tree. The monolithic construction of the improved tubing head adapter 2 with ball valve presents separate access to the valving means and substantially eliminates the probability of successful disassembly of an unattended christmas tree on a producing well.

It can thus be seen that the improved invention provides in a single integrated monolithic unit a substantially strong valving system for controlling all pressures coming through the tubing head adapter together with providing support for a christmas tree onto an oilwell casing. It can also be seen that the invention is susceptible of a number of varying implementations and embodiments all of which are substantially as stated in the claims rather than as being restricted to the specific preferred embodiment described herein.

I claim:

1. A tubing head adapter for insertion above an oil well casing head in an oil well or deep hole well, comprising:

a. a substantially cylindrical casing, having an internal longitudinal axial bore;

b. means for fixedly attaching the outer casing to the oilwell casing head;

c. a ball valve means inserted within the cylindrical casing in fluid communication with the internal axial bore, adapted to be actuated between a first open and a second closed position; wherein the ball valve means further comprises:

i. a lower valve seat positioned annularly within the axial bore of the cylindrical casing;

ii. a lower tapered ball seat ring member disposed on top of said lower seat;

iii. a floating ball member contactingly supported upon said lower seat ring, wherein said ball member is provided with an opening diametrically therethrough;

iv. an upper tapered ball seat ring member contactingly disposed on top of said ball member;

v. an upper valve seat positioned annularly within the axial bore of the cylindrical casing atop said upper seat ring; and vi. a threaded gland member threadingly engaged within said cylindrical casing to clamp said upper valve seat against said upper seat ring and said ball member, thereby preventing said ball member from vertical displacement while allowing its floating rotation.

2. An apparatus as described in claim 1 above, wherein said ball member further comprises radially extending stem actuation means, thereby defining an axis of rotation of said ball member from an open to a closed position reciprocatingly.

3. An apparatus as described in claim 2 above wherein said stem actuation means further comprise:

a. substantially theft resistant, tamper resistant actuation lockout, preventing access or actuation of the valve.

* * * * *